United States Patent [19]
LeBlanc
[11] 4,256,250
[45] Mar. 17, 1981

[54] METHOD AND APPARATUS FOR SETTING FASTENER ELEMENTS INTO A BLANK

[75] Inventor: Conrad LeBlanc, Montreal, Canada
[73] Assignee: DRG Limited, Ontario, Canada

[21] Appl. No.: 960,655
[22] Filed: Nov. 14, 1978
[30] Foreign Application Priority Data
Nov. 30, 1977 [CA] Canada ..... 292095
[51] Int. Cl.³ ..... A41H 39/04
[52] U.S. Cl. ..... 227/17; 227/18; 227/20; 227/81; 227/85; 227/90; 227/113
[58] Field of Search ..... 227/81, 85, 90, 91, 227/92, 95, 96, 152, 15, 16, 18, 17, 20, 113

[56] References Cited

U.S. PATENT DOCUMENTS

| | | | |
|---|---|---|---|
| 510,844 | 12/1893 | Crowell | 227/81 |
| 527,574 | 10/1894 | Wood | 227/95 |
| 615,253 | 12/1898 | Crowell | 227/81 |
| 677,711 | 7/1901 | Stapf | 227/81 |
| 686,738 | 11/1901 | Kaschenbach | 227/81 X |
| 2,722,000 | 11/1955 | Turrall | 227/81 |
| 3,200,487 | 8/1965 | Fluke | 227/20 X |
| 3,367,550 | 2/1968 | Jezierski | 227/81 |
| 3,964,663 | 6/1976 | Jureit et al. | 227/152 X |

FOREIGN PATENT DOCUMENTS

| | | | |
|---|---|---|---|
| 519678 | 12/1955 | Canada | 227/81 |
| 759636 | 5/1967 | Canada | 227/81 |
| 848796 | 8/1970 | Canada | 227/81 |

*Primary Examiner*—Paul A. Bell
*Attorney, Agent, or Firm*—Stevens, Davis, Miller & Mosher

[57] ABSTRACT

This relates to the production of folders such as those commonly used for binding loose sheets of paper into booklet form. There is provided a method and an apparatus for setting fastener elements, such as tangs and eyelets, into selected portions of a blank made of heavy paper or cardboard. The apparatus employs rotary die holding elements defining a nip or nips therebetween for receiving one or more portions of a paper blank, particularly a blank folded to a T-shaped configuration. The apparatus includes means for applying setting forces to the fastener elements during the very brief interval of time that the fastener elements are disposed in the nip or nips between the die holders. Radially movable dies are mounted in certain of the rotary holders and cam means are employed to apply momentary fastener element setting forces to the fasteners. These momentary setting forces are applied in such a way that crushing of the leading edge or edges of the fastener elements coming into the nip or nips between the rotary elements is substantially avoided. The apparatus is capable of operation in a very rapid manner with the tangs and eyelets being positionally matched in accurate fashion and securely installed.

18 Claims, 20 Drawing Figures 10
12
14
16
18
20
22
24
26
28
30
32
34
36
38
40
42
44
B
E
F
T

METHOD AND APPARATUS FOR SETTING FASTENER ELEMENTS INTO A BLANK

This invention relates to the production of folders such as those commonly used for binding loose sheets of paper into booklet form. The invention is particularly directed to a method and an apparatus for setting fastener elements, particularly tangs and eyelets, into selected portions of a blank made of heavy paper or cardboard.

The fastener elements e.g. the eyelets and tangs, which are to be set into the paper blank are, per se, well known in the art. These fasteners are usually made from relatively thin sheet metal stock. The tangs are commonly stamped from metallic stock folded upon itself so as to provide a cylindrical hollow rivet-like head having a pair of superimposed prongs extending outwardly to one side thereof with one prong being preferably somewhat shorter than the other. The eyelets are also stamped from metallic stock thereby to provide a cylindrical body portion having an outwardly turned flange at one end thereof.

It is a principal object of the present invention to provide improved method and apparatus for setting tang and eyelet units in a suitably folded paper blank and to carry out such operation in a rapid manner and such that the tangs and eyelets are positionally matched in accurate fashion and securely installed.

A number of years ago, various types of machines were devised which were capable of folding a flat blank into a T-shaped configuration. In one form of folding apparatus, the front and back of each blank are bent along spaced parallel lines relative to a central strip therebetween to form a channel configuration. The folded blank is then bent reentrantly and creased at both sides of the central strip into a T-shape with the front and back of the blank closely adjacent and the two arms of the T doubled. The next step was to apply to the doubled arms of the T an eyelet and a tang respectively at like distances from the leading edge of the blank. For most folders, at least two and most commonly three sets of tang and eyelets were required. After the eyelets and tangs were set into the arms of the T-shape, the opposite arms of the T were then bent into closely adjacent relationship thereby to bring the respective sets of eyelets and tangs into close proximity with one another. Finally, the front and back of the blank were hinged into juxtaposition with one another along lines adjacent and parallel to the bend lines for the arms of the T thereby to provide a final product.

The ultimate user could then readily insert prepunched paper sheets in the folder by bending the prongs of the tang elements outwardly and inserting same through the respective holes of the sheet or sheets of paper with the prongs being then inserted through the respective eyelets and then bent away from one another in opposite directions.

The final product is primarily used for reports of various kinds and has found wide usage in commercial offices, educational systems etc.

The prior art has provided various types of apparatus for applying tangs and eyelets to folders of the nature suggested above, but they have not been entirely satisfactory. In some cases the fastener elements were fed into a hand-operated machine, the operation of which was slow, expensive and tedious. Other more recent machines have incorporated means for automatically feeding tangs and eyelets to a plurality of setting dies, the latter being operated in a reciprocating fashion to set the eyelets and tangs into the blank at the required locations. These reciprocating-type machines were capable of operating automatically; however, by virtue of their reciprocating nature, a stop and go form of feed system was required for moving the paper blank through the machine. Because of the speed limitations inherent in this form of operation, the apparatus for setting the tangs and eyelets became a bottleneck in the production line. Although machines for folding the paper blanks can and have been produced which will operate at a very high rate of speed, the full production capabilities of such machines were never realized as a result of the inherent limitations in the fastener setting apparatus.

It is accordingly a principal object of the present invention to provide improved apparatus and methods for rapidly setting fastener elements, particularly eyelets and tangs in blanks of the type referred to above.

It is a further object of the invention to provide an apparatus and method for setting fasteners into blanks, the apparatus employing rotary die holding elements defining a nip or nips therebetween for receiving one or more portions of a paper blank, the apparatus including means for applying setting forces to fastener elements fed to the apparatus during the very brief interval of time that the fastener elements are disposed in the nip or nips between the die holders.

It is a further object of the invention to provide apparatus including rotary die holders with radially movable dies mounted in certain of said holders and means for actuating the radially movable die holders to apply momentary fastener element setting forces to fasteners fed to the nip or nips between such rotary die holders.

It is a further object of the invention to provide a method and apparatus for setting fastener elements including rotary means capable of providing fastener element setting forces to fastener elements fed into the nips between rotary die holders with the momentary setting forces being applied in such a way that crushing of the leading edge or edges of the fastener elements coming into the nip is substantially avoided.

Thus, in accordance with the invention in one aspect there is provided, apparatus for setting a fastener element, such as an eyelet or a tang, in a blank, comprising means defining a path of travel for the blank, a fastener element setting station in said path of travel including a plurality of rotary die holder means mounted for rotation about a pair of spaced parallel axes and defining a nip therebetween for receiving a portion of the blank, spaced apart fastener element setting dies carried by the die holder means in such a way that, upon rotation of the die holder means about their respective spaced axes, successive pairs of said fastener element setting dies come into opposing relationship with one another in the nip, means for momentarily applying fastener element setting forces to each opposing pair of setting dies while they are in the nip, means for advancing the blank edgewise along the path of travel in timed relation to the rotation of the die holder means to bring said portion of the blank into the nip, means for feeding fastener elements to the setting dies in such a way that individual fastener elements are carried into a position between the respective opposing pair of setting dies along with a portion of the blank whereby, upon application of said momentary forces to said setting dies, individual fasteners are successively set into said portion of the blank.

In a typical embodiment of the invention there is provided appartus for setting eyelets and tangs in a blank which has been folded to a T-shape. The apparatus includes means defining a path of travel for the blank. A tang and eyelet setting station is disposed in the path of travel and includes a plurality of rotary die holder means mounted for rotation about a pair of spaced parallel axes and defining a pair of nips therebetween for receiving the opposing arms of the T-folded blank. Spaced apart tang setting dies and spaced apart eyelet setting dies are carried by the die holder means in such a way that, upon rotation of the die holder means about their respective axes, successive pairs of tang setting dies come into opposing relationship with one another in a first of the nips while successive pairs of eyelet setting dies come into opposing relationship with one another in the second one of the nips. Means are provided for momentarily applying tang and eyelet setting forces to each opposing pair of setting dies while they are in the first and second nips. The apparatus includes means for advancing the blank edgewise along the path of travel in timed relation to the rotation of the die holder means to bring each of the opposing arms of the T-folded blank into a respective one of the first and second nips. Also included are means for feeding tangs and eyelets to the tang setting dies and eyelet setting dies respectively in such a way that individual tangs and eyelets are carried into the first and second nip to positions between the respective opposing pairs of setting dies along with the opposing arms of the T-folded blank. Thus, upon application of the momentary forces to the setting dies, individual tangs are successively set into one of the arms of the T-shaped blank while individual eyelets are successively set into the other arm of the blank.

In a preferred form of the invention, the means for applying the setting forces includes cam means. The apparatus also includes means mounting a first set of the tang setting dies and the eyelet setting dies to permit limited radial movement thereof relative to their associated die holder means. Such mounting means may include portions associated therewith which are engageable with the cam means during rotation of the die holders to impart the momentary tang and eyelet setting forces to the setting dies. In the preferred form of the invention, the cam means is arranged to impart the momentary forces only when the respective opposing pairs of setting dies lie substantially in an imaginary plane passing through the spaced parallel rotation axes of the die holder means. By virtue of this arrangement, there is assurance that the opposing pairs of setting dies are substantially in axial alignment with one another at the time of application of the setting forces. This is of importance in avoiding crushing of the leading edge portions of the tangs and eyelets which are moving into the nips between the respective die holder means.

In accordance with a further preferred feature of the invention, the plurality of rotary die holder means may include a first rotary die holder arranged for rotation about a first one of said parallel axes, and second and third rotary die holders mounted for rotation about the other one of said spaced parallel axes, the second and third rotary die holders being spaced apart in the axial direction by a distance sufficient to-permit the leg of the T-shaped blank to pass therebetween during operation.

In the preferred form of the invention, the first rotary die holder carries said first set of said eyelet setting dies and said tang setting dies in circumferentially spaced relationship, with each of the dies of the first set being radially movable relative to said first axis of rotation, and means biasing each of the dies of the first set away from said first axis of rotation.

The first set of said dies are preferably disposed in pairs about the circumference of the first die holder, each pair comprising an eyelet setting die and a tang setting die, and the second rotary die holder carrying a set of said tang setting dies each arranged to come into said opposing relationship with a respective one of the tang setting dies of the first set, and the third rotary die holder carrying a set of said eyelet setting dies each arranged to come into said opposing relation with a respective one of the eyelet setting dies of the first set.

In accordance with a further feature of the invention, the means for feeding tha tangs and eyelets includes means for supplying individual tangs to respective tang setting dies of one of said rotary die holder means prior to entry of such tang setting dies into said first nip, and magnetic means on said one of the rotary die holder means for retaining the individual tangs on the respective tang setting dies until the tangs have been set into said one of the arms of the blank.

The means for supplying individual tangs also preferably includes means for feeding a strip of interconnected tangs in step by step fashion toward a peripheral portion of said one of the rotary die holder means in timed relation to the rotation of the latter, and means for successively separating individual leading tangs from said strip and applying same to the respective tang setting dies for retention thereon by said magnetic means.

The above-referred to means for feeding tangs and eyelets also advantageously includes chute means for delivering eyelets to a peripheral portion of said one of the rotary die holders, means for temporarily holding successive leading ones of said eyelets at a pick-up station, means for moving successive eyelet setting dies radially outwardly relative to the rotation axis thereof in such a way that each successive eyelet setting die comes into seating engagement with a respective one of said eyelets at the pick-up point, and means for supporting and guiding each said eyelet as it is carried into the second nip by the eyelet setting die associated therewith.

A preferred embodiment of the invention will be now be described by way of example with reference being had to the accompanying drawings wherein.

Figure 1:
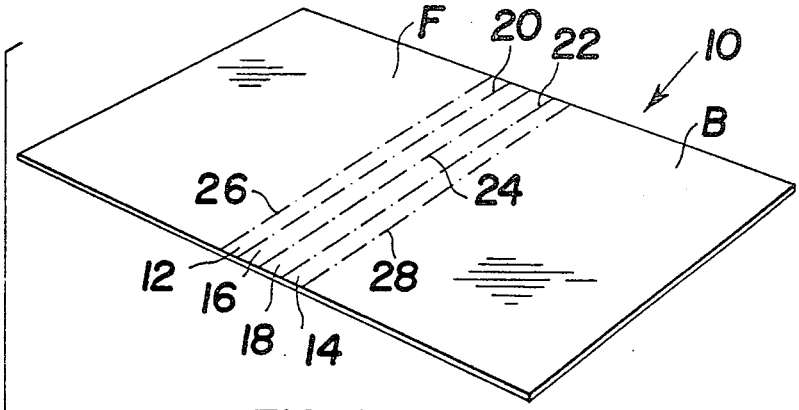
FIG. 1 is a perspective view of a typical blank showing lines of fold therein.
Figure 2:
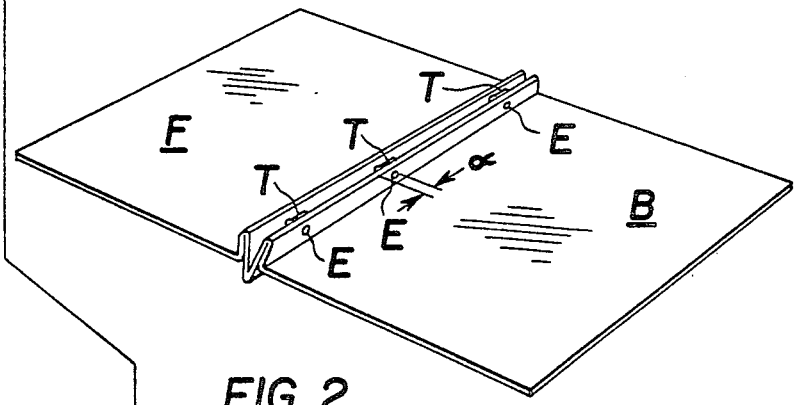
FIG. 2 PRIOR ART
FIG. 2 is a perspective view of the finished folder in the open position for receiving loose sheets of paper to be bound.
Figure 3:
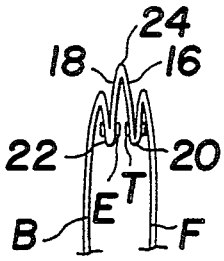
FIG. 3 is an end elevation view of the folded central portion of the finished folder having tangs and eyelets connected thereto.

With reference now to the drawings, FIGS. 1-3 give background details relating to folders of the type referred to previously. A folder blank 10 is shown in its flat condition in FIG. 1 and a finished but opened folder having tangs and eyelets therein is shown in FIG. 2. For purposes of convenience, F is the front and B is the back of the folder. The flat blank includes excess material disposed between the front and back portions capable of forming several folds along the various fold lines shown by the dashed lines in FIG. 1. In the embodiments shown, the strips 12 and 14 are folded flat against strips 16 and 18 along th fold lines 20 and 22 respectively. Tangs T and eyelets E are set into these folded strips 12, 16, and 18, 14, and the centrally disposed strips 16 and 18 are folded relative to one another about a central fold line 24. The front F and the back B of the folder are then folded relative to strips 12 and 14 about respective fold lines 26 and 28 thereby to produce the final form of the folder as shown in FIG. 3.

It might be noted here that the weight of the paper from which the folder blank is made is typically designated as ten and one-half point paperboard. The blank is usually embossed at the same time as it is being died-out into blanks thereby to provide a front identification panel as well as the above-referred to fold lines together with such overall design features as are desired.

Figures 4, 5, 6, 7:
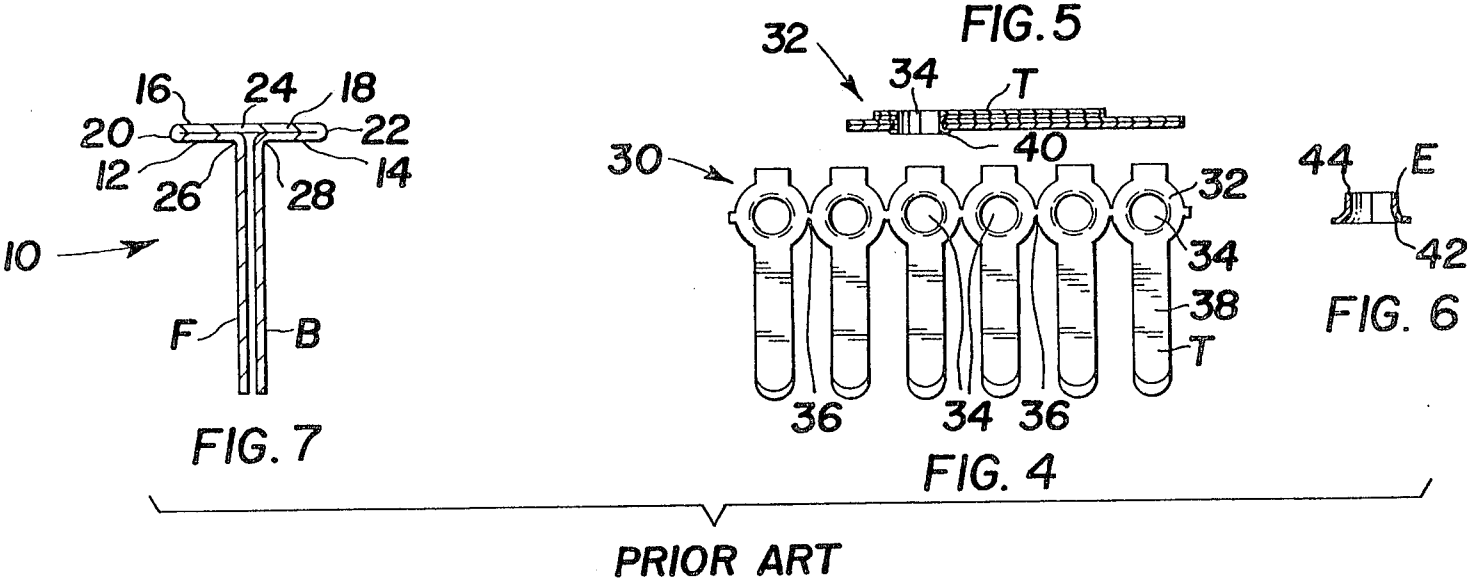
FIG. 7 PRIOR ART
FIG. 4 is a plan view of a strip of interconnected tangs of the type such as are usable in apparatus according to the present invention.
FIG. 5 is a section view of a portion of a folder having a tang element set therein.
FIG. 6 is a section view of a typical eyelet.
FIG. 7 is an end view of a blank folded to a T-shape in the condition in which it appears just prior to entry into tang and eyelet setting apparatus in accordance with the present invention.

In FIG. 4 there is shown a strip 30 of tang-type paper fasteners T integrally united to form a continuous strip. The strip of fasteners consists of a series of cylindrically shaped head portions 32 each having an aperture 34 therein. These head portions 32 are interconnected by means of a series of narrow tie portions 36. In fabricating the strip, the malleable sheet metal is folded upon itself so as to provide a pair of prongs 38 extending outwardly to one side of each of the head portions 32. With reference to FIG. 5 there is shown in cross-section a tang-fastener element T secured to a pair of plies of paper with the head portion of the fastener element extending through the plies of paper and being curled around as shown at 40 thereby to securely lock the tang element T to the paper plies.

With reference to FIG. 6 there is shown a typical eyelet E, such eyelet comprising a generally cylindrical hollow body having an outwardly flared portion 42 at one of its ends. In order to set such an eyelet into a paperboard sheet, the eyelet is driven into the paper and end portion 44 of the eyelet is thereafter curled around outwardly and downwardly by a setting die, thereby to firmly secure the eyelet in the paper sheet.

For purposes of convenience in this specification, the individual fastener elements of strip 30 as shown in FIG. 4 will simply be referred to as tangs, while fastener elements of the type illustrated in FIG. 6 will simply be referred to as eyelets.

With reference to FIG. 7 there is shown a blank 10 of paper folded into a T-shape with the opposing arms of the T comprising the respective superposed strip portions 12, 16 and 18, 22 respectively and the leg of the T comprising the generally parallel spaced apart front and back portions F and B respectively of the folder. The T-folded blank as shown in FIG. 7 effectively forms the starting point for a method in accordance with the present invention. Those skilled in the art will appreciate that various forms of apparatus may be employed to provide the T-folded blank of FIG. 7 in a rapid and efficient manner; however, since such folding apparatus does not, per se, form a part of the present invention, such apparatus need not be described herein.

Figure 8:
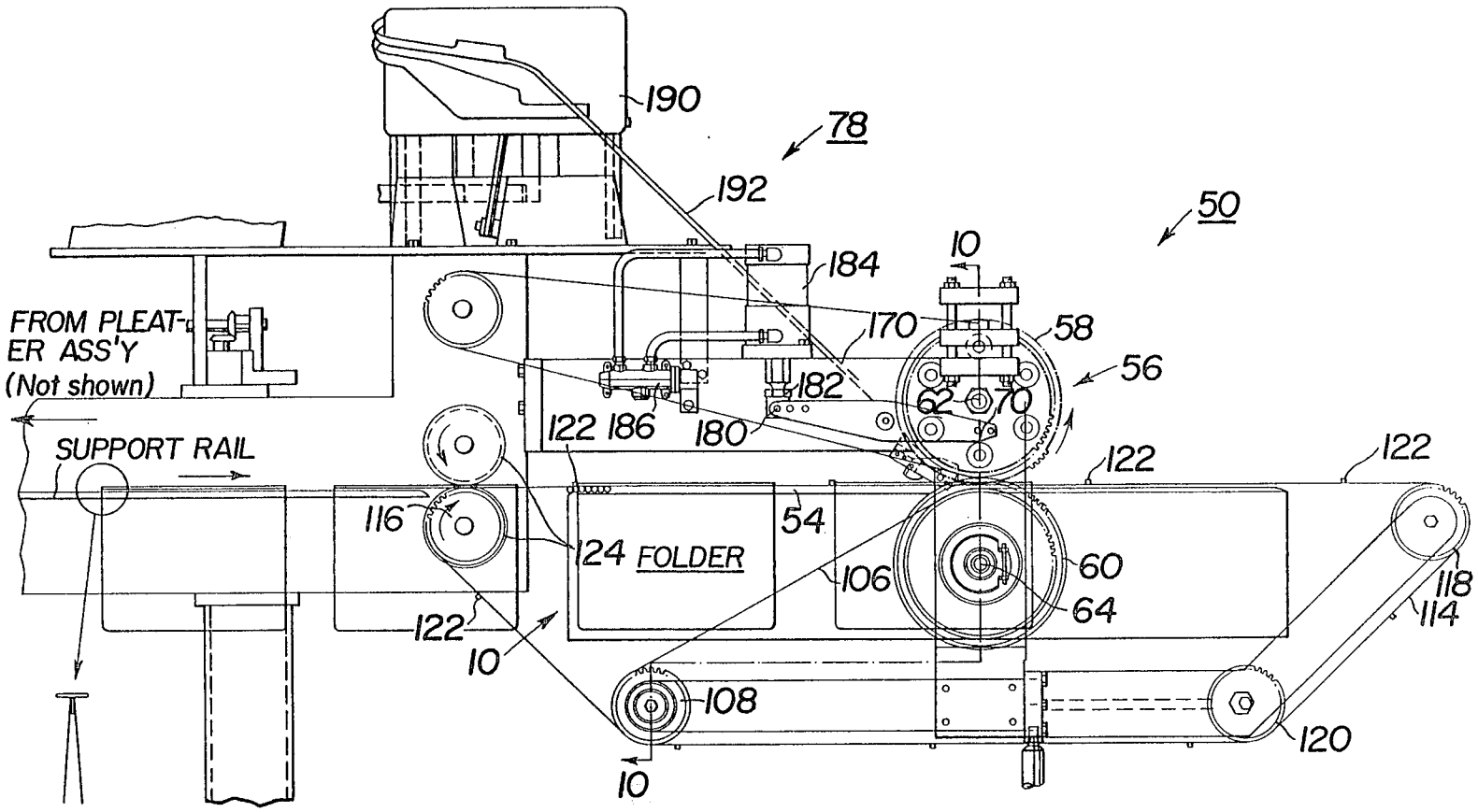
FIG. 8 is a side elevation view of tang and eyelet setting apparatus according to the invention.
Figure 9:
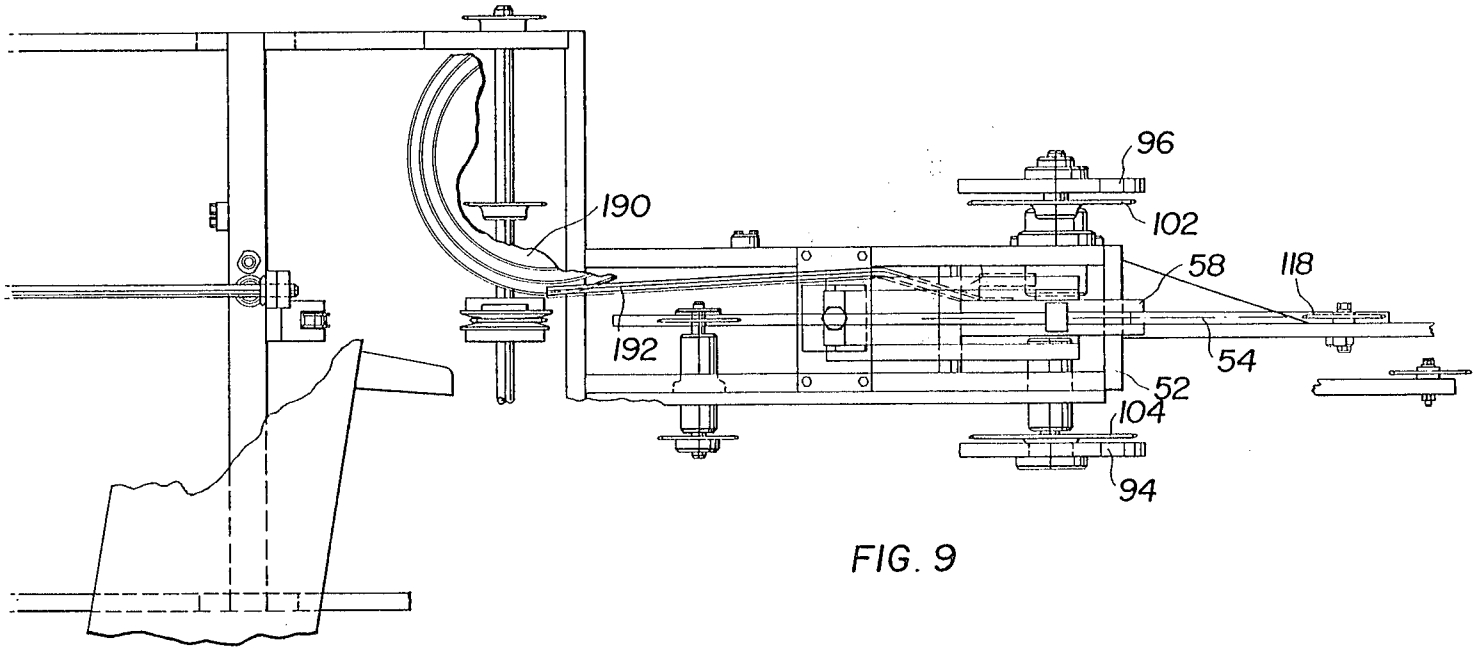
FIG. 9 is a plan view of the tang and eyelet setting apparatus.
Figure 10:
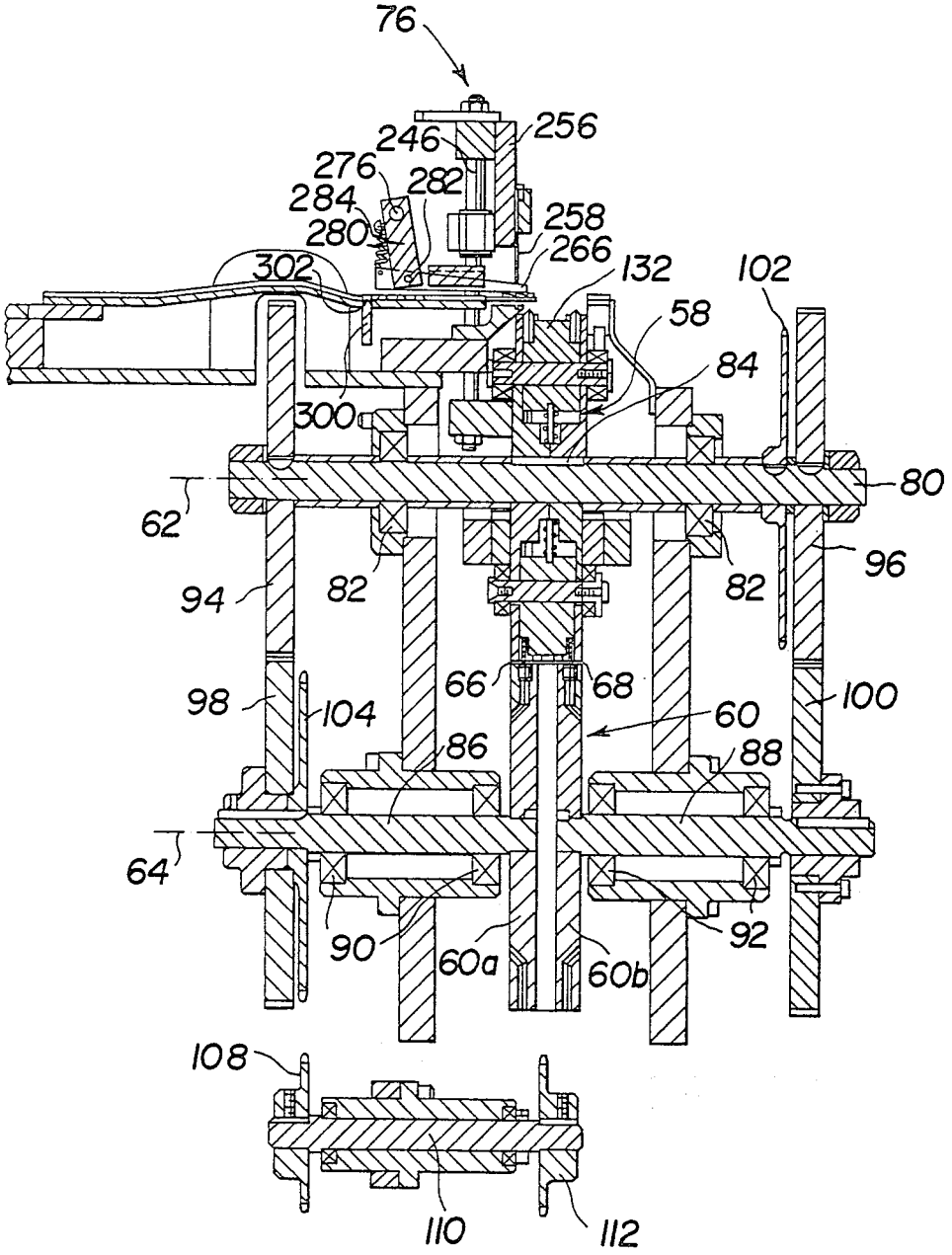
FIG. 10 is a section view through the rotary die holder means and associate structures taken along section line 10—10 of FIG. 8.

With reference now to FIGS. 8, 9 and 10, there is shown apparatus 50 in accordance with the invention for setting eyelets and tangs as described above in a blank 10 which has been folded to a T-shape as illustrated in FIG. 7. The apparatus includes a main frame 52 within which the various components of the apparatus are mounted such components to be described in further detail hereinafter. A path of travel for the T-shaped blank is defined by a narrow elongated support rail 54, such path of travel extending to and through a tang and eyelet setting station designated by reference numeral 56. The setting station includes primary and secondary rotary die holders 58 and 60 respectively, the latter being mounted for rotation about spaced parallel axes 62 and 64 respectively. The primary and secondary rotary die holders 58 and 60 define a pair of nips 66, 68 therebetween for receiving the opposing arms of the T-folded blank. Spaced apart tang setting dies and spaced apart eyelet setting dies are carried by the rotary die holders 58 and 60 in such a manner that, upon rotation of same about their spaced axes 62, 64, successive pairs of tang setting dies come into opposing relationship with one another in nip 66 while successive pairs of eyelet setting dies come into opposing relationship with one another in nip 68. Means, including cam elements 70, serve to momentarily apply tang and eyelet setting forces to each of the opposing pairs of setting dies while they are in the first and second nips 66, 68. A drive chain system 72, serves to advance the blank edgewise along the path of travel defined by support rail 54 in timed relation to the rotation of die holders 58 and 60 thereby to bring each of the opposing arms of the T-folded blank into a respective one of the nips 66, 68. The apparatus also includes a mechanism for feeding individual tangs to the tang setting dies of the primary die holder 58; such tang feeding apparatus is designated by the reference numeral 76. The apparatus further includes a system, designated by reference numeral 78, for feeding eyelets to the eyelet setting dies of the rotary die holders so that the individual tangs and eyelets are carried into the respective nips 66 and 68 to positions between opposing pairs of setting dies along with the opposing arms of the T-folded blank. Thus, upon application of the momentary forces to the setting dies. individual tangs T are successively set into one of the arms of the T-shaped blank while individual eyelets are successively set into the other arm of the blank.

Figure 11:
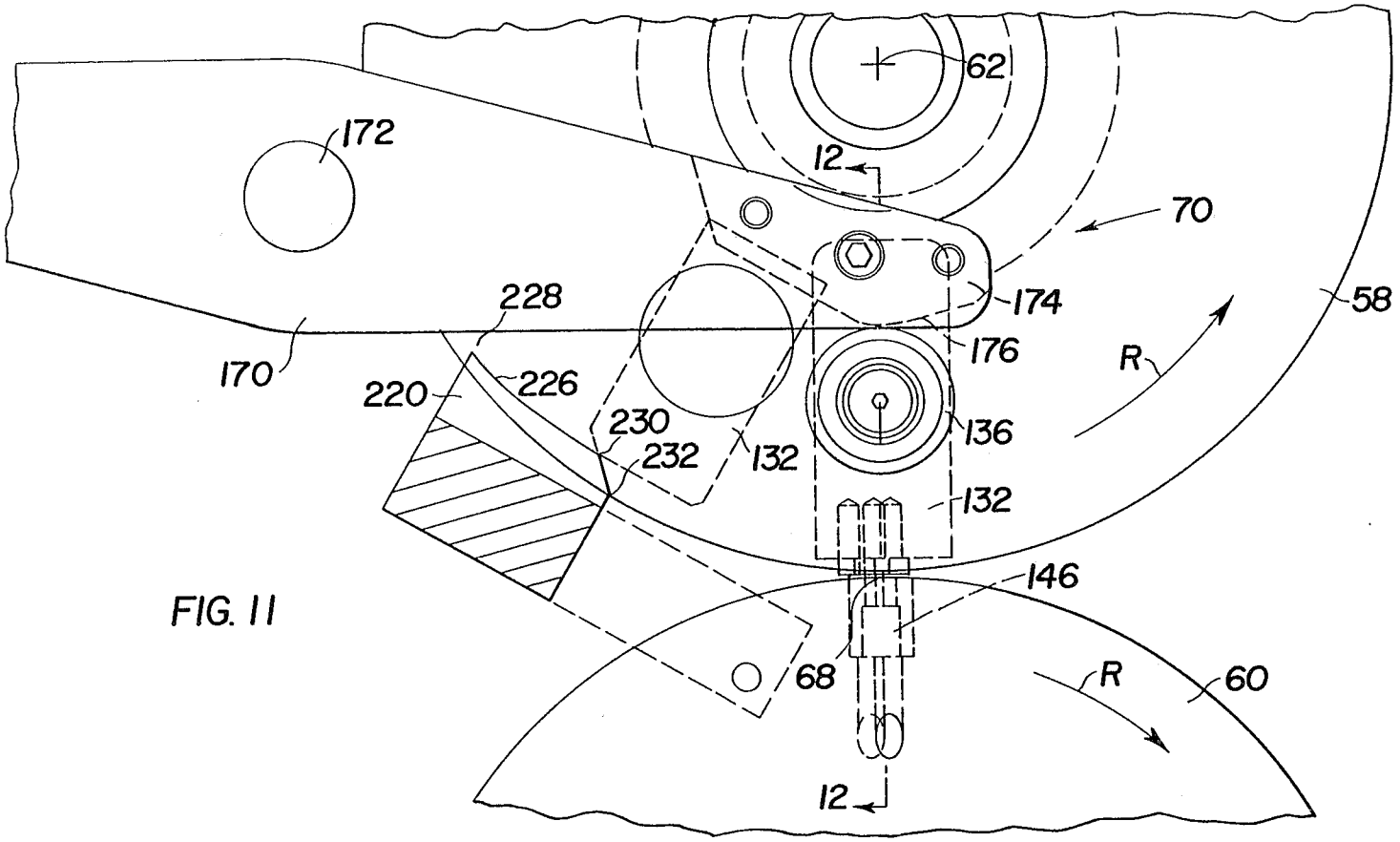
FIG. 11 is a fragmentary side elevation view, partly in phantom, of the rotary die holder means, together with certain cam arrangements associated therewith.
Figure 12:
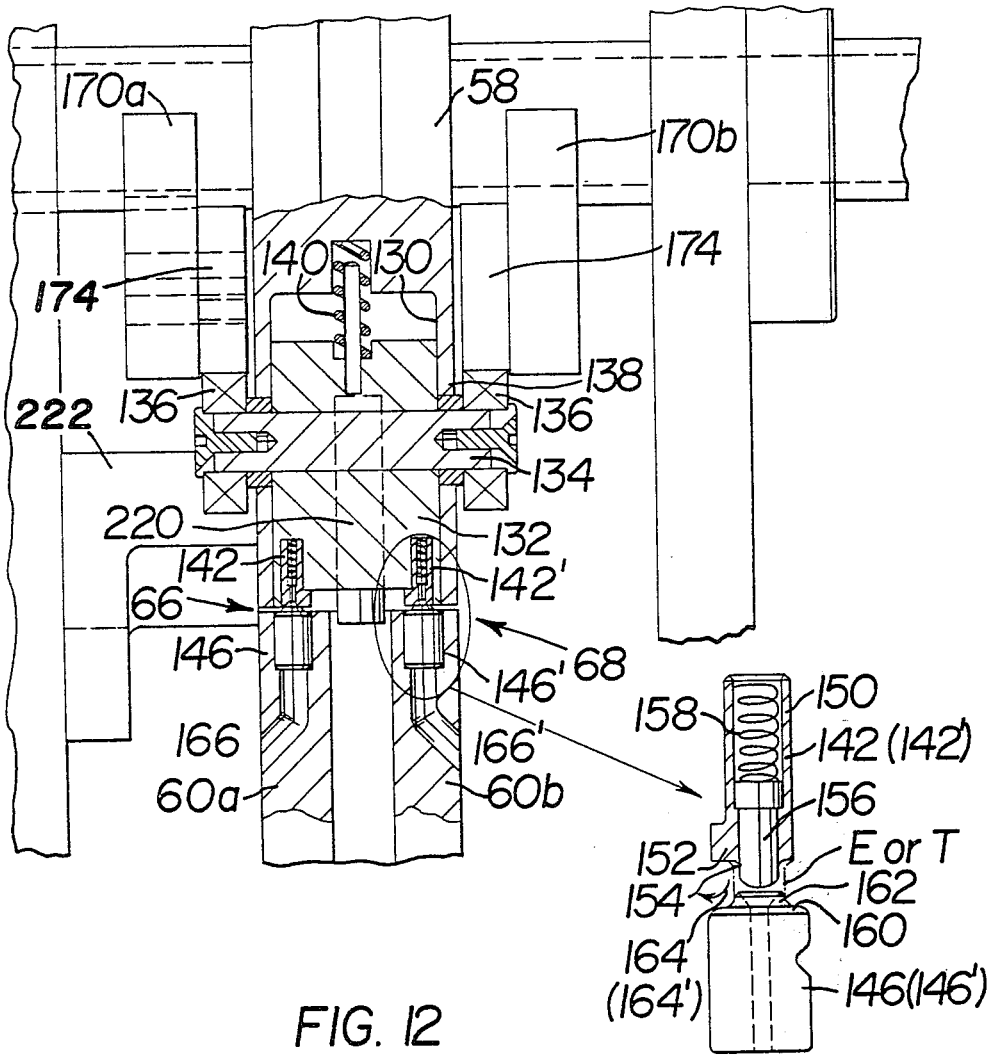
FIG. 12 is a further fragmentary elevation view of the rotary die holder elements and being partially in section, such section being taken along line 12—12 of FIG. 11.

With reference to FIGS. 10, 11 and 12, it will be seen that the primary die holder 58 is mounted on a horizontal shaft 80, the latter being journalled in bearings 82 which, in turn, are bolted to the machine frame. A key 84 prevents any relative rotary motion between shaft 80 and primary die holder 58. The secondary die holders 60 comprise a spaced apart pair of substantially identical die holders 60*a* and 60*b*. As noted previously, these die holders are mounted for rotation about axis 64, the latter being defined by a pair of axially aligned shafts 86 and 88, which are securely keyed to secondary die holders 60*a*, 60*b* respectively. The axial spacing between secondary die holders 60*a* and 60*b* is sufficient to permit the leg of the T-shaped blank to pass therebetween during operation. The leg of the T-shaped blank is shown in dashed lines in FIG. 10. The shafts 86 and 88 are mounted to the machine frame via axially spaced bearings 90, 92 respectively.

In order to enable the primary die holder 58 and the secondary die holders 60 to be driven in synchronism, the outboard ends of shaft 80 are each provided with a primary drive gear 94, 96 respectively which mesh with secondary drive gears 98, 100, respectively, the latter being mounted to the respective outboard ends of shafts 86, 88 respectively.

Mounted to shaft 80 just inboard of gear 96 is a drive sprocket 102 which is connected via a drive chain to a main drive motor and gear reduction assembly (not shown) which assembly drives the entire apparatus at the desired rate of speed. A further sprocket 104 is mounted to shaft 86 just inboard of gear 98. Sprocket 104 is connected via drive chain 106 to a further sprocket 108 which, in turn, is conected by a shaft 110 to sprocket 112. With reference to FIG. 8, a drive chain 114 is trained around a sprocket 112 as well as around sprockets 116, 118, and 120. All of these sprockets lie in a common vertical plane passing through the horizontally disposed support rail 54. The upper horizontal reach of the drive chain 114 is in fact supported directly on top of the support rail 54 so that the drive chain horizontal reach actually passes between secondary die holders 60*a*, 60*b*, closely adjacent nips 66 and 68 as previously referred to. The drive chain 114 is provided with a plurality of drive dogs 122, such drive dogs being equally spaced apart along the length of drive chain 114 with the spacing between such drive dogs being related in predetermined fashion to the length of the folders 10 being transported edgewise along the support rail 54. As best seen in FIG. 8, the drive dogs 122 each engage a respective trailing edge of the blanks thus positively advancing same along the path of travel defined by the support rail into the nips 66 and 68 defined between the primary and secondary die holders. The drive chain 114 is driven by the sprocket means described above at a rate such that the speed of movement of each folder 10 is identical to the peripheral speed of the primary and secondary die holders so that there is no relative movement between the arms of the T-folded blank and the portions of the primary and secondary die holders which come into contact therewith in nips 66 and 68 in the manner to be described hereinafter. It is also noted here that a pair of press rolls 124 are disposed in the path of travel of the folded blanks and are driven in rotation via the drive chain 114. The press rolls are not shown in detail, it being sufficient to mention here that they are arranged to engage the upper and lower surfaces of the arms of the T-shaped blank thereby to sharpen the creases therein shortly before the blank is advanced toward the nips between the primary and secondary die holders.

The primary die holder 58 is provided with a plurality of radially directed pockets 130 in its periphery, such pockets 130 being equally spaced apart circumferentially. Within each pocket 130 there is disposed an associated die block 132. Each die block 132 is capable of limited radial motion relative to the rotaion axis 62 of the primary die holder. Each die block 132 has a short stub shaft 134 extending therethrough. the opposing ends of stub shaft 134 projecting outwardly beyond the opposing sides of primary die holder 58 with such opposing ends of the stub shafts 134 each carrying a respective roller 136. The apertures 138 in the primary die holder through which the stub shafts pass are somewhat elongated in the radial direction thereby to define the limits of radial travel of the respective die blocks 132. At the bottom of each of the pockets 130 there is disposed a respective compression spring 140 which compression springs 140 serve to bias their respectively associated die blocks 132 radially outwardly.

Each die block 132 carries an axially spaced apart pair of setting dies 142 and 142'. Die element 142 effects the setting of the tang elements T while die element 142' effects the setting of the eyelet elements E.

The secondary die holders 60*a*, 60*b* are provided with a corresponding number of equally circumferentially spaced die elements 146, 146'. Thus, during rotation of the primary and secondary die holders in synchronism, successive ones of the die elements 142 come into opposing relationship with successive die elements 146 in nip 66 thereby to effect setting of the tang elements T into one of the arms of the T-folded blank while at the same time successive die elements 142' come into opposing relationship with respective ones of the die elements 146' in the other nip 68 thereby to effect the setting of individual eyelets E into the other arm of the T-folded blank. In order to effect the setting of the tangs and eyelets, it is necessary that compression forces be applied to the die elements 142, 146 and 142',146' during the time that the respective die elements are in substantial alignment with one another in nips 66 and 68. A means for applying these compression forces will be described hereinafter.

Figure 15:
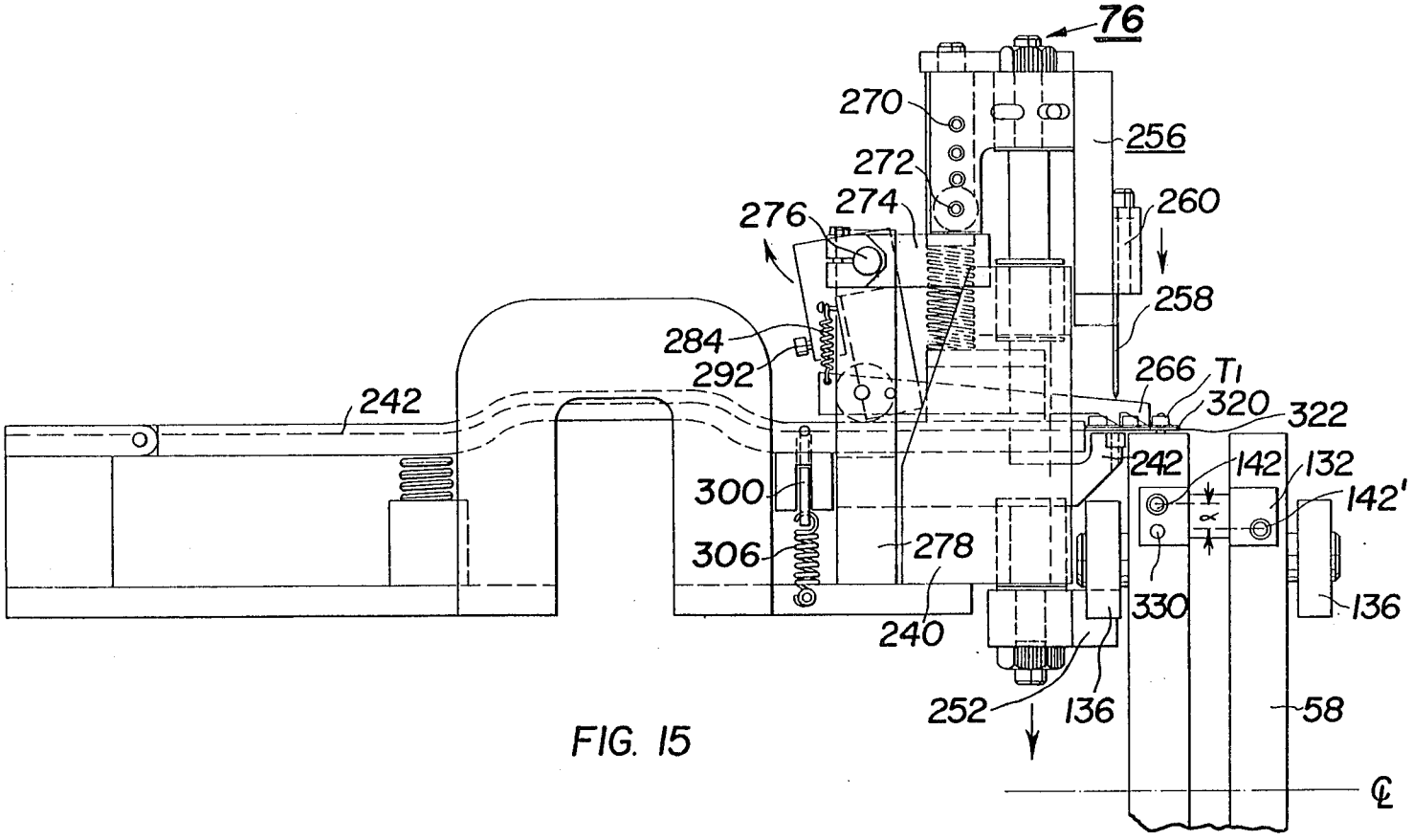
FIG. 15 is a side elevation view of the tang feeder mechanism.
Figure 16:
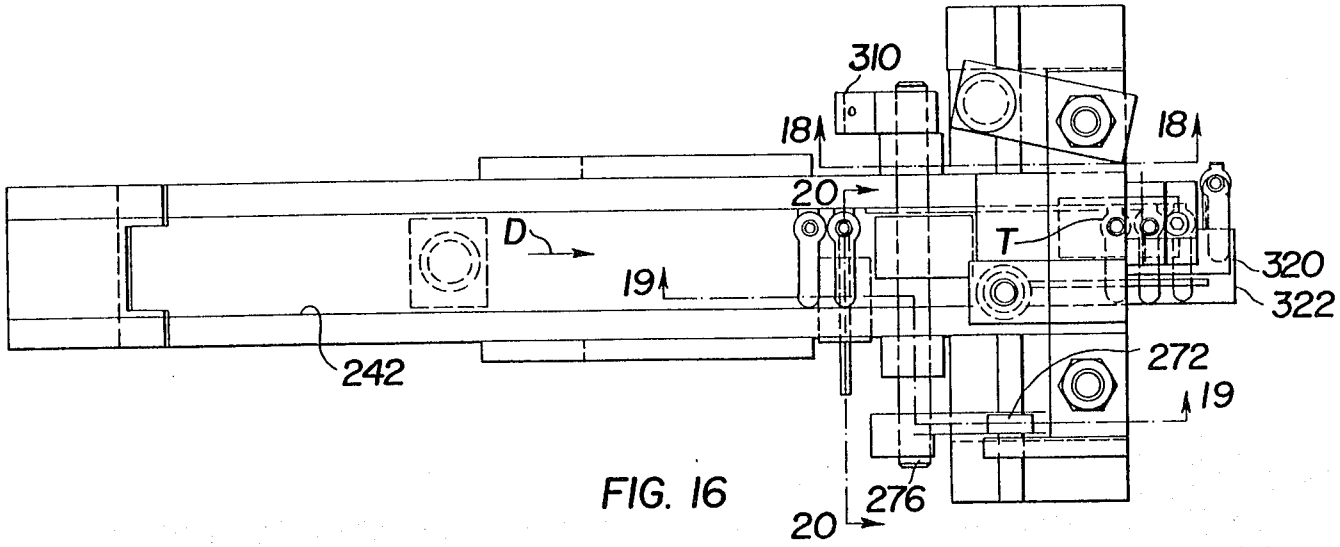
FIG. 16 is a plan view of the tang feeder mechanism.

With reference to FIG. 15 it will be noted that the die elements 142 are slightly off-set from the die elements 142' in the circumferential direction of the primary die holder as illustrated by the reference $\alpha$. The same degree of offset is also, of course, present in respect of the pairs of die elements 146, 146' in the secondary die holders 60*a*, 60*b*. The reason for this is that it is not desirable to have the eyelet E disposed directly opposite to the head portion of the tang T in the finished product. With reference to FIG. 2, it will be seen that the tangs and eyelets are off-set from one another by a corresponding distance $\alpha$ such that when the prongs of the tang T are bent outwardly at right angles to their associated heads, they can readily be inserted into the eyelets.

This practice is, per se, well known in the art and need not be described further at this point.

Die elements 142, 142' each comprise a hollow shell-like body portion 150 which seats snugly in an aperture disposed in the outwardly directed face of die block 132. Die elements 142, 142' also each include an annular face portion 152 having an annular lip 154 concentrically disposed thereon and against which annular face 152 the outwardly flaring head portion of tang T seats during the setting operation. Die elements 142, 142' have a hollow interior, within which is disposed an axially movable plunger 156, the nose of which normally projects outwardly relative to the annular face 152. A coil compression spring 158 disposed within die element 142, 142' urges plunger element 156 radially outwardly. This plunger element serves to assist in centering and locating the head of the tang T, or an eyelet E, as the case may be, relative to the die element during operation. However, during the actual setting operation, since the die elements 142, 142' are urged toward the opposing die element 146, 146' the compression forces involved serve to push the plunger 156 back into the interior of the die elements 142, 142' so that plunger 156 does not in any way interfere with the actual setting operation.

The die element 146 comprises a generally cylindrical hollow body which is received in its associated secondary die holder **60*a*. The die holder also includes an annular face portion 160 and an outwardly directed annular lip 162 having a minimum diameter which is slightly less than the diameter of the cylindrical edge portion of the head of the tang T. An annular concavely curved or filleted portion extends between the edge of the annular lip 162 and the generally flat annular face 160. Thus, as die element 142 is forced toward die element 146, the annular edge of the head of the tang T is curled generally outwardly and around in the direction illustrated by arrow 164 thereby to securely anchor the head of the tang to the arm of the T-folded blank which is interposed between die elements 142 and 146 during operation. The secondary die holder 60*b* also carries a corresponding plurality of die elements 146' similar to the die elements carried by secondary die holder 60*a*. Those skilled in the art will realize that, during operation, as die element 142' is forced toward die element 146', the cylindrical edge of eyelet E will be gradually curved outwardly and around in the direction of arrow 164'** thereby to effect setting of the eyelet E on the other arm of the T-folded blank.

In order to apply the necessary tang and eyelet setting forces to the die elements, at the time the respective die elements are disposed in nips 66 and 68, a cam system 70 is associated with the primary die holder 58. The cam system 70 includes an elongated bifurcated lever arm 170 which is pivotally connected to the main frame via a pivot shaft 172. As best seen in FIG. 12, arm portions **170*a*, and 170*b* are disposed in flanking relationship to primary die holder 58, with the ends of these arm portions each carrying a respective cam block 174. During operation, the cam blocks 174 are so arranged such that the camming surfaces 176 thereof come into engagement with the respective rollers 136 which are connected via stub shafts 134 to the associated die blocks 132. Thus, as shown in FIG. 11, for example, as the primary and secondary die holders 58 and 60 rotate in synchronism in the direction of arrows R, the cam blocks 174 serve to impart downwardly directed forces to the successive pairs of rollers 136 which come into contact therewith with such compressive forces being applied to the successive die blocks 132 when the opposing pairs of die elements of the primary and secondary die holders are in substantial axial alignment with each other (i.e. at that point in time when they all lie substantially in an imaginary plane passing through the spaced parallel rotation axes 62 and 64 of the rotating die holders). By applying setting forces to the respective tang and eyelet elements only when the opposing sets of die elements are in substantial mutual alignment, crushing of the leading edge portions of the fastener elements coming into the nips 66 and 68** is substantially avoided.

Referring again to the cam system 70 for applying momentary forces to the setting dies, it will be noted that the end of the cam lever 170 remote from cam blocks 174 is connected at pivot axle 180 to the plunger 182 of a pneumatic cylinder 184. The cylinder 184 is connected to an air supply valve 186 which, in turn, is connected to a regulated source of air pressure (not shown). By decreasing or increasing the air pressure supplied to cylinder 184, one can readily increase or decrease the amount of pressure being applied by cam blocks 174 to the roller elements 136 thereby to enable one to modify the setting forces applied to the tangs and elements in a desired manner.

Figure 13:
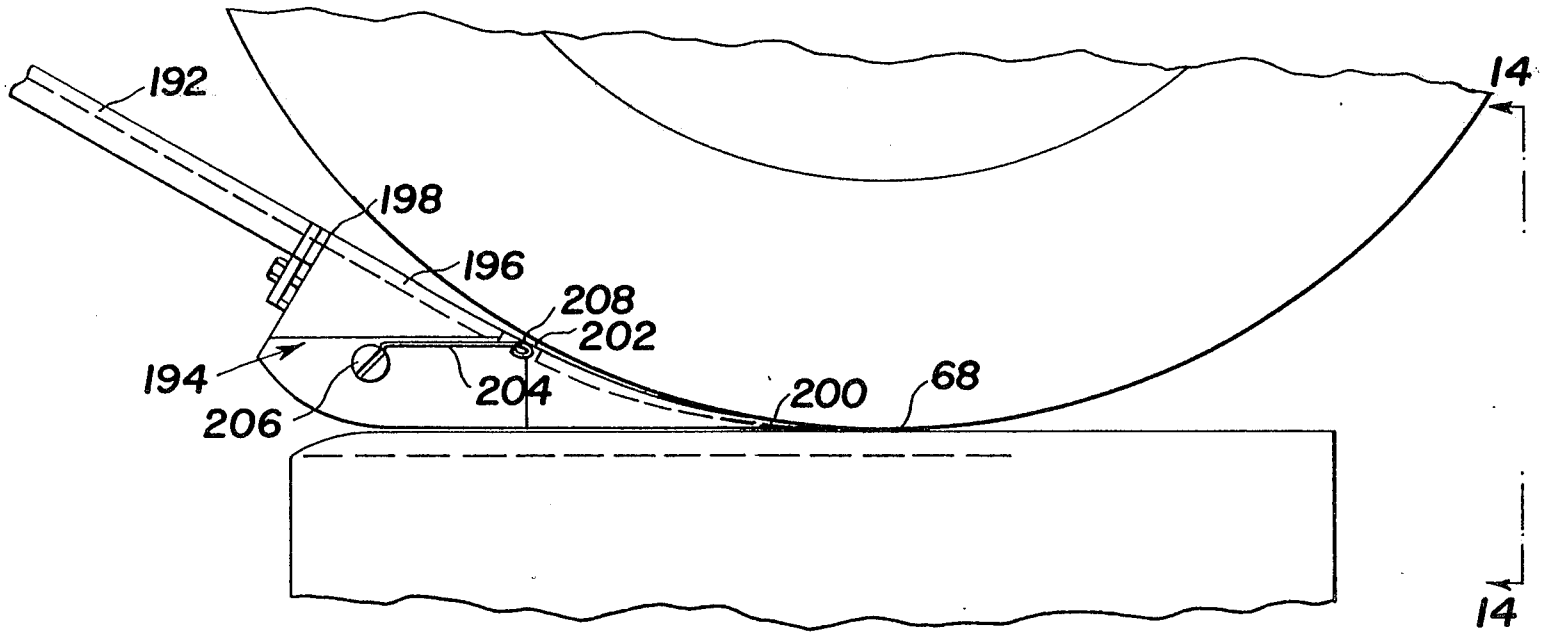
FIG. 13 is a side elevation view of a portion of the eyelet feed mechanism in the region of the nip between the rotary die holders.
Figure 14:
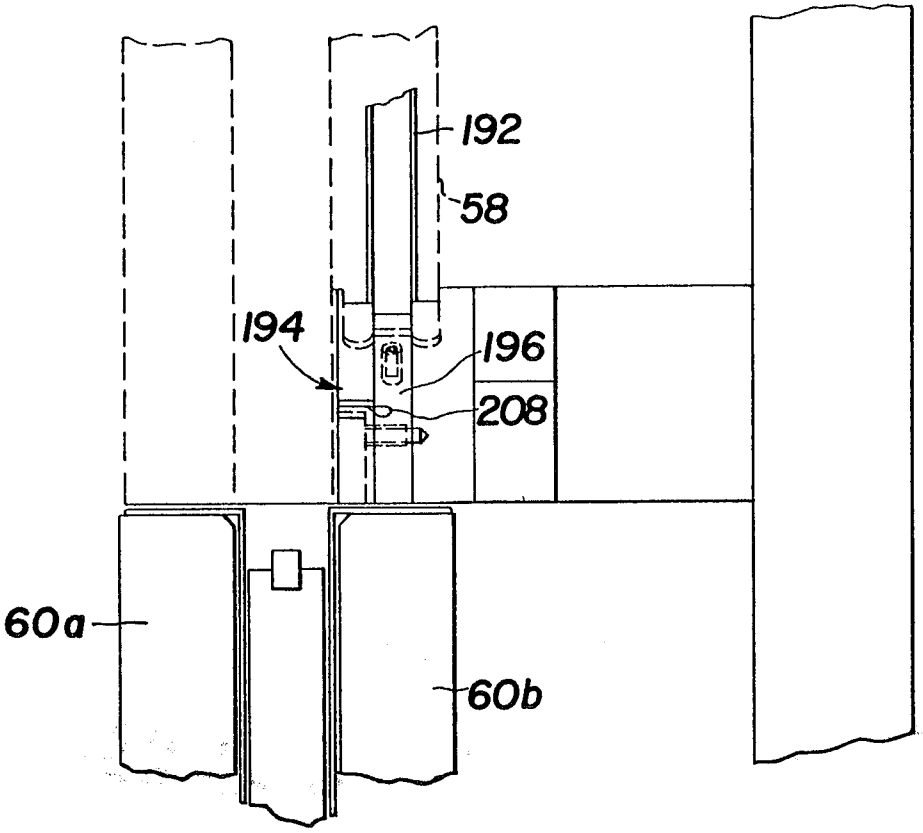
FIG. 14 is a view of a portion of the eyelet feed mechanism, such view being taken from the position designated by lines 14—14 in FIG. 13 and looking in the direction of the arrows.

The previously mentioned system 78 for supplying individual eyelets to nip 68 between the primary and secondary die holders will now be described. With reference to FIG. 8 there is shown a vibratory feeder 190 mounted to the machine frame at an elevation well above the elevation of nip 68. The vibratory feeder may be of any well known commercially available variety (e.g. a Syntron vibratory feeder), the same being provided with commercially available guide means and eyelet orienting means thereby to ensure that the eyelets being fed outwardly therefrom are all oriented with their outwardly directed flange portions disposed uppermost. These oriented eyelets then slide down an elongated channel-shaped in cross-section chute 192. With reference to FIGS. 13 and 14, the lower end of chute 192 is connected to an eyelet guide 194. The eyelet guide 194 comprises an elongated tapered metal block which is so contoured as to extend well into the nip 68 which is defined between primary die holder 58 and the secondary die holder **60*b*. The upper surface of the eyelet guide is provided with an eyelet guide channel 196 which gradually decreases in depth from the inlet end 198 thereof to the exit end 200 as best seen in FIG. 13. A recessed or cut out portion 202 is provided about half way along the length of one of the side walls of the guide channel 196. A small diameter rod of spring steel 204 is attached to a side of the eyelets guide by fastener 206 with such steel wire having a loop 208 formed on a free end thereof with the wire 206 being bent so that the loop portion 208 extends into the channel 196 and into the path of the eyelet moving therealong. Thus, the loop portion 208** defines the so-called "pick-up" position of the eyelets.

With reference now to FIGS. 11 and 12 there is shown a cam block 220 which is positioned generally alongside of the eyelet guide 194, such cam block 220 being mounted to the machine frame via bracket 222. The cam block 220 is positioned such that it lies in a plane mid-way between the nips 66, 68 defined by the primary and secondary die holders. The upper surface 226 of cam block 220 is of a predetermined contour and is arranged to contact the respective die blocks 132 mid-way between the die elements 142 and 142' supported thereon. Thus, with reference to FIG. 11, as primary die holder 58 turns in the direction of arrow R, the die blocks 132 are successively contacted by cam block 220 and are moved thereby in the manner which will now be described. It will be seen from FIG. 11 that the upper surface of cam block 220 is concavely curved radially inwardly from point 228 to point 230 relative to the rotation axis 62 of primary die holder 58. From point 230 to 232, the surface of cam block 220 slopes fairly steeply outwardly relative to rotation axis 62. Thus, as primary die holder 58 rotates, the die holder 132 will first contact cam block 220 shortly after point 228 and will be moved radially inwardly relative to rotation axis 62 of the primary die holder 58 until such time as the trailing edge of die block 132 reaches point 230 on the cam. Continued movement of primary die holder 58 will cause the die block 132 to follow along the sloping surface of the cam from point 230 to point 232 i.e. the die block 132 moves radially outwardly. As die block 132 moves radially outwardly, the tip of the spring biased plunger 156 in die element 142' enters into the eye of an eyelet E which is being held at the aforementioned pick-up point by the loop 208 of the spring steel wire 204. Continued movement of primary die holder 58 causes the eyelet to be moved along the channel 196 with the result being that the wire springs back momentarily to release the eyelet thus allowing it to be carried along channel 196 into the nip 68. As the die block 132 moves into the nip, the lower edge of the eyelet slides along the bottom of the channel 196. Since this channel gradually decreases in depth, the eyelet tends to push the die block 132 back into its pocket 130 against the biasing force exerted by compression spring 140. However, as the die block 132 approaches the nip, the rollers 136 associated therewith come into engagement with the previously described cam blocks 176 which exert an outwardly radially directed force on the cam block 132 which force, as described above, serves to effect the setting of the eyelet in one of the arms of the T-shaped blank as described previously.

Figure 17:
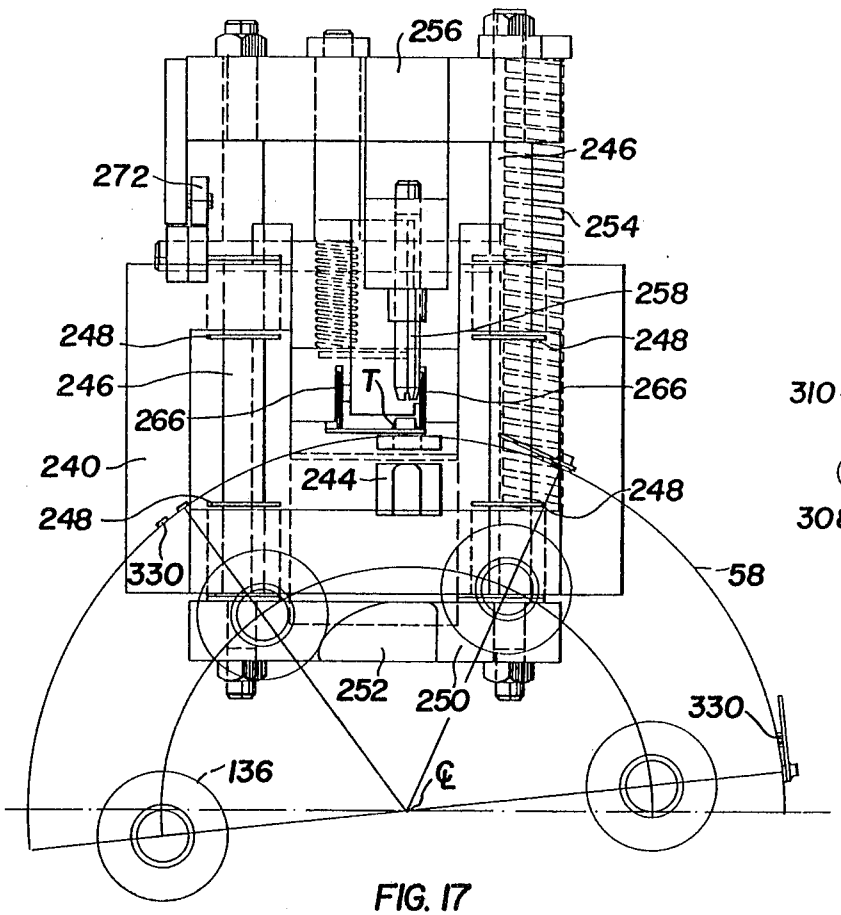
FIG. 17 is a front elevation view of the tang feeder mechanism with a portion of the primary die holder arrangement being shown in phantom.
Figure 19:
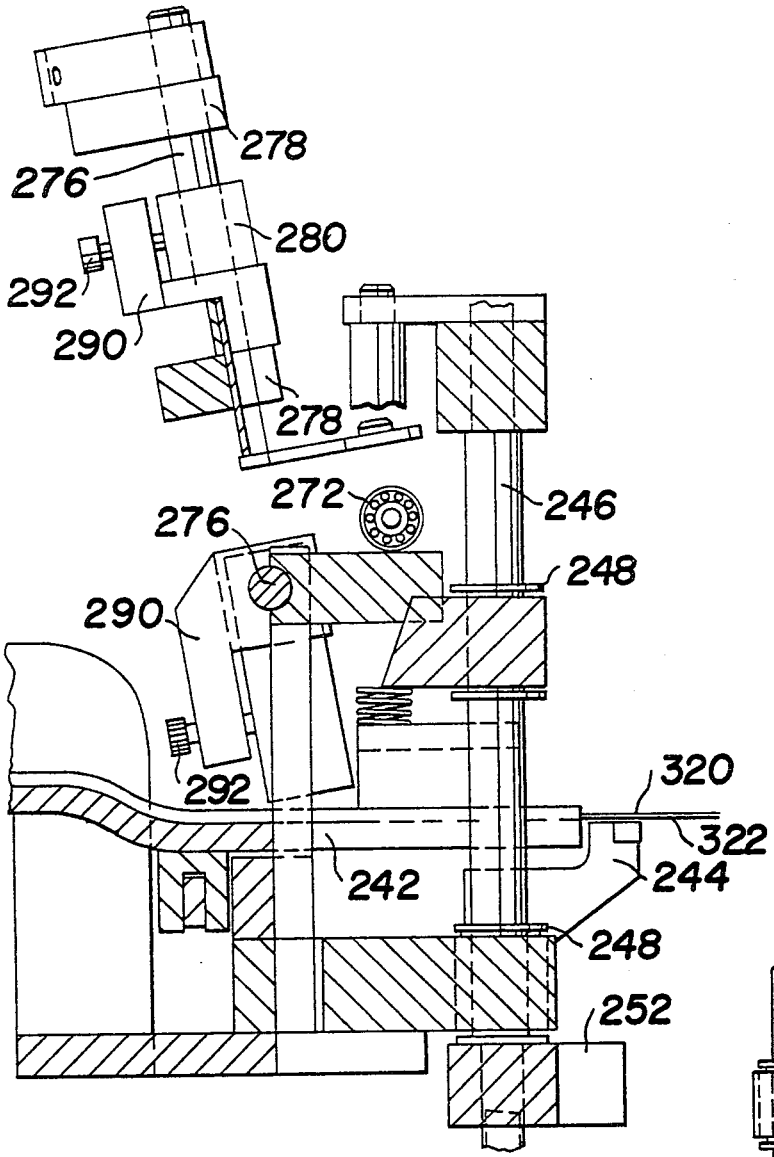
FIG. 19 is a section view taken along line 19—19 in FIG. 16.

The previously mentioned apparatus 76 for supplying tang elements to the primary die holder 58 will now be described with reference to FIGS. 15–20. The tang feeder mechanism 76 includes a sub-frame 240 having an elongated guide channel 242 connected thereto and defining a path of travel for a strip of interconnected tangs 30 as previously described. The strip of tangs is caused to move along guide channel 242 in the direction of arrow D in step by step fashion from a supply reel for the tangs (not shown). The guide channel 242 terminates adjacent the front end of the tang feed assembly with a cutter anvil 244 being located at the front end of channel 242 in closely spaced relation to the periphery of the primary die holder 58 as best seen in FIG. 15. A pair of spaced upright draw-down shafts 246 are mounted in spaced parallel relationship adjacent the front end of the tang feed assembly 76, such shafts 246 extending through suitable bearings 248 mounted in sub-frame 240. The lower ends of draw-down shaft 246 are secured to a cross-member 250, the latter having a cutter and feed cam 252 mounted thereon as best seen in FIG. 17. The cam 252 is mounted in a position such that it is engaged by the successive rollers 136 as the primary die holder 58 is rotated about its axis. Thus, as primary die holder 58 rotates, the rollers 136 successively engage cam 252 thus causing shafts 246 to be successively pulled downwardly relative to sub-frame 240 with return of the shafts to the uppermost positions being provided for by coil compression springs 254. The upper ends of the shaft 246 are connected to a head assembly 256, with the head assembly 256 having a cutter blade 258 and a cutter blade mount 260 connected thereto. Cutter blade 258 is arranged to cooperate with the cutter anvil 244 to successively sever the narrow ties 36 between the individual tangs of the strip.

Figure 20:
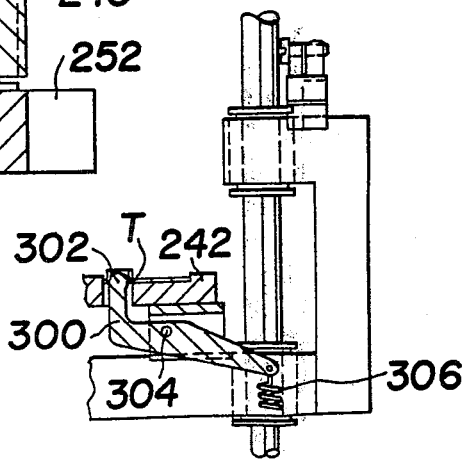
FIG. 20 is a section view taken along line 20—20 in FIG. 16.

In order to effect step by step feeding of the strip of tangs 30, the apparatus is provided with a pair of feed fingers 266 which operate in unison to advance strip 30 by an amount equal to the width of a tang T during each operational cycle of the device. The feed fingers 266 extend through respective narrow slots in a guide block 268 thereby to avoid any unwanted lateral displacement of the feed fingers during operation. In order to effect movement of the feed fingers 266, head assembly 256 is provided with a support bracket 270 to which is connected a feed roller 272. Feed roller 272 engages with the upper surface of a pivot arm 274, the latter being securely connected adjacent its rearwardly disposed end to a horizontally disposed main feed shaft 276. The feed shaft 276 is journalled in a pair of spaced apart upright members 278 connected to the sub-frame 240. The feed shaft 276 is connected in turn to a feed lever 280. The lower end of the feed lever is connected via pivot shaft 282 to a rearwardly disposed portion of each of the feed fingers 266. A relatively light tension spring 284 is interconnected between feed lever 280 and the rearmost end of feed fingers 266 thereby to bias the forwardly disposed ends of such feed fingers downwardly and into engagement with the strip of tangs 30. It should be noted here that the feed lever 280 is not keyed to feed shaft 276. Rather, there is further mounted on feed shaft 276 an adjustable feed lever 290, a portion of which is disposed immediately behind feed lever 280. An adjustment screw 292 extends through member 290 and makes contact with the feed lever 280. This adjustment screw 292 enables one to make fine adjustments in the feed arrangement thereby to ensure that the cutter blade 258 accurately severs the strip of tangs at the narrow connections 36 between the individual tangs. It will be seen from the above that as the head assembly 256 is drawn downwardly by cam 252 and draw-down shafts 246 that the feed roller 272, in contact with pivot arm 274, will cause the main feed shaft 276 to rotate clockwise as seen in FIG. 15. As main feed shaft 276 rotates clockwise, the feed arm 280 is likewise caused to rotate counterclockwise thus retracting feed fingers 266 rearwardly and away from the primary die holder 58. The light tension spring 284 permits the forwardly disposed ends of the feed fingers 266 to lift upwardly and ride over the tangs of the strip. In order to facilitate this action, the outermost ends of the feed fingers 266 are provided with rearwardly sloping ramp portions 296. Rearward movement of the strip of tangs 30 along guide channel 242 is prevented by virtue of a tang strip locate arm 300, as best seen in FIG. 20, the arm 300 being disposed below guide channel 242 and having a tip portion 302 which projects upwardly into the path of movement of the tangs so that it engages in the head portions of the successive tangs. The locate arm is provided with a pivot axle 304 and has at its end remote from the tip portion 302, a light tension biasing spring 306 which enables the tip portion 302 to retract out of the path of travel of the strip of tangs as the latter are being moved along the path by the feed fingers 266.

The tip portion 302 of the locate arm is suitably rounded as to avoid snagging of the tangs thereon.

Figure 18:
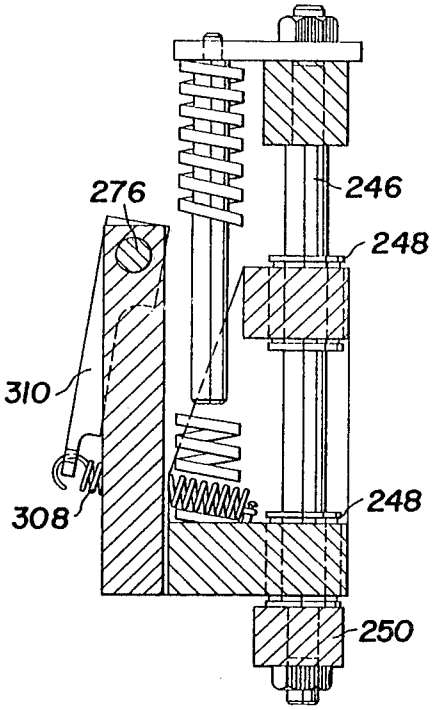
FIG. 18 is a section view taken along line 18—18 in FIG. 16.

The strip of tangs 30 is positively advanced by the feed fingers 266 during the time that the head assembly 256 is moving upwardly. This forward motion is provided, in part, by a tension feed spring 308 (see FIG. 18) which is interconnected between the sub-frame 240 and the free end of a torque arm 310. The other end of the torque arm 310 is securely keyed to the feed shaft 276 and thus tends to bias feed shaft 276 in the counterclockwise direction as seen in FIGS. 15 and 18. Thus, by virtue of the above-described arrangement, as head assembly 256 moves toward its uppermost position under the influence of the compression springs 254, the tension spring 308 acts to rotate main feed shaft 276 in the counterclockwise direction thus effecting corresponding rotation of the feed arm 280 and causing the tangs to be advanced by one step having a length equal to the width of the tang.

With reference again to FIG. 15, it will be seen that the outermost tang T1 has previously been separated from the strip. In order to prevent such tang from falling aimlessly onto the surface of the primary die holder 58, the feed apparatus 76 includes a pair of superposed flat spring steel strips which extend parallel to the guide channel 242 with such steel strips gently embracing the upper and lower surfaces of the prongs of the tang. These flat steel strips are designated by reference numbers 320, 322. With the outermost tang T1 being thus held gently in position by the superposed steel strips 320, 322, rotation of the primary die holder 58 brings a die block 132 and its associated die element 144 into a position directly below the head of the outermost tang. The superposed steel strips 320, 322 hold the head of the tang in such a position that the head portion of same is engaged by the spring biased locating plunger 156 provided in the die element 142. The tang thus is firmly engaged by the moving plunger and is thus drawn outwardly from between the superposed steel strips 320, 322. In order to prevent the individual tangs from falling off the setting die 142, it is important to note here that each die block is provided with a small magnet 330 which is located immediately rearwardly of its associated die element 142 (relative to the direction of rotation) so that the individual tangs are held securely to such magnets 330 until the tangs have entered the nip 66 between the primary and secondary die holders.

The overall operation of the machine will be readily evident from the above detailed description. However, by way of a brief summary of the operation, the T-folded blank is advanced edgewise along the path of travel defined by rail 54 toward the tang and eyelet setting means 56. The primary and secondary die holders 58, 60 are rotated about their respective spaced axes 62, 64 so that successive pairs of tang setting dies 142, 146 come into opposing relationship with one another in a first of the nips 66 while successive pairs of eyelet setting dies 142', 146' come into opposing relationship with one another in the second one of the nips 68. Tangs T and eyelets E are fed to the tang setting dies and eyelet setting dies by the above described mechanisms so that individual tangs and eyelets are carried into the first and second nips 66, 68 respectively to positions between the respective opposing paris of setting dies. At the same time each of the arms of the T-folded blank are fed into a respective one of the first and second nips. Tang and eyelet setting forces are momentarily applied to each opposing pair of setting dies 142, 146 and 142', 146' while they are in the first and second nips. Thus, by virtue of the application of said momentary forces to said setting dies, individual tangs are successively set into one of the arms of the T-shaped blank while individual eyelets are successively set into the other arm of the blank. The above described operations can be carried out in a continuous fashion and at a high rate of speed. After the desired number of tangs and eyelets have been set into the blank, the blank passes outwardly beyond the rotary feed holders and is folded by any suitable means into the final form shown in FIG. 3.

A preferred embodiment of the invention has been described by way of example and those skilled in the art will realize that numerous modifications and variations may be made thereto while still remaining within the scope and spirit of the invention as outlined in the claims appended hereto.

I claim:

1. Apparatus for setting a fastener element, such as an eyelet or a tang, in a blank, comprising means defining a path of travel for the blank, a fastener element setting station in said path of travel including a plurality of rotary die holder means mounted for rotation about a pair of spaced generally parallel axes and defining a nip therebetween for receiving a portion of the blank, a plurality of circumferentially spaced apart fastener element setting dies carried by each of the die holder means for rotation therewith in such a way that, upon rotation of the die holder means about their respective spaced axes, successive pairs of said fastener element setting dies come into opposing relationship with one another in the nip, means for advancing the blank edgewise along the path of travel in timed relation to the rotation of the die holder means to bring said portion of the blank into the nip, means for feeding fastener elements to the setting dies in such a way that each fastener element is carried into a position in the nip between a respective opposing pair of said setting dies along with a portion of the blank, and means for momentarily applying fastener element setting forces during the rotation of the rotary die holder means which forces act through each said opposing pair of setting dies while they are in the nip to set the respective fastener elements positioned therebetween, whereby, upon application of the momentary fastener element setting forces individual fasteners are successively set into said portion of the blank.

2. Apparatus according to claim 1 wherein the means for momentarily applying the setting forces includes cam means, means mounting a first set of said circumferentially spaced fastener element setting dies to permit substantially radial movement thereof relative to the rotation axis of their associated die holder means, and the mounting means for the setting dies of the first set having portions associated therewith which are engageable with said cam means during rotation of the die holders to effect outward radial movement thereof relative to the rotation axis associated with said first set to impart said momentary setting forces to the setting dies.

3. Apparatus according to claim 2 wherein said cam means is adapted to impart said momentary forces only at positions of the rotary die holder means where a respective opposing pair of said setting dies lie substantially in an imaginary plane passing through said spaced parallel rotation axes of the die holder means.

4. Apparatus according to claim 1 wherein the means for feeding the fastener elements includes means for supplying individual elements to respective setting dies of one of said rotary die holder means prior to entry of such setting dies into said nip, and magnetic means on said one of the rotary die holder means for retaining the individual elements on the respective setting dies until the elements have been set into said portion of the blank.

5. Apparatus according to claim 4, wherein the means for supplying individual fastener elements comprises means for feeding a strip of interconnected elements in step by step fashion toward a peripheral portion of said one of the rotary die holder means in timed relation to the rotation of the latter, and means for successively separating individual leading elements from said strip and applying same to the respective setting dies for retention thereon by said magnetic means.

6. Apparatus according to claim 4 wherein the means for feeding fastener elements includes means for delivering the elements to a location adjacent the nip defined between the rotary die holders, means for temporarily holding successive leading ones of said elements at a pick-up station, means for moving successive setting dies of said first set first radially inwardly and then radially outwardly relative to the rotation axis thereof in such a way that each successive setting die of said first set comes into engagement with a respective one of said fastened elements at the pick-up point, and means for supporting and guiding each said element as it is carried into the nip by the setting die associated therewith.

7. Apparatus according to claim 6 wherein the last mentioned fastener element is of a type having an eyelet opening therein; said apparatus being further characterized in that each setting die of the first set is provided with a respective spring loaded plunger adapted to enter into the eyelet opening of the fastener element at the pick-up point whereby to positively move each such element into the nip.

8. Apparatus for setting eyelets and tangs in a blank which has been folded to a shape which includes a pair of oppositely directed arms: comprising means defining a path of travel for the blank, a tang and eyelet setting station in said path of travel including a plurality of rotary die holder means mounted for rotation about a pair of spaced parallel axes and defining a pair of nips therebetween for receiving the opposing arms of the folded blank, means for rotating the die holder means at a preselected rotational speed, spaced apart tang setting dies and spaced apart eyelet setting dies carried by the die holder means in angularly spaced relation about the rotation axes of their respectively associated die holder means for rotation therewith so that upon rotation of the die holder means about their respective spaced axes, successive pairs of tang setting dies come into opposing relationship with one another in a first of the nips while successive pairs of eyelet setting dies come into opposing relationship with one another in the second one of the nips, means for advancing the blank edgewise along the path of travel in timed relation to the rotation of the die holder means to bring each of the opposing arms of the folded blank into a respective one of the first and second nips, means for feeding tangs and eyelets to the tang setting dies and eyelet setting dies in such a way that individual tangs are carried into the first nip and eyelets are carried into the second nip to positions between the respective opposing pairs of setting dies along with the opposing arms of the folded blank, means for momentarily applying tang and eyelet setting forces during the rotation of the rotary die holder means which act through each opposing pair of setting dies while they are in the first and second nips, whereby, upon application of said momentary forces to said setting dies, individual tangs are successively set into one of the arms of the shaped blank while individual eyelets are successively set into the other arm of the blank.

9. Apparatus according to claim 8 wherein the means for applying the setting forces includes cam means, means mounting a first set of said tang setting dies and said eyelet setting dies to permit radial movement thereof relative to their associated die holder means, and the mounting means for the dies of the first set having portions associated therewith which are engageable with said cam means during rotation of the die holders to impart said momentary tang and eyelet setting forces to the setting dies.

10. Apparatus according to claim 8 wherein said cam means is adapted to impart said momentary forces only when said respective opposing pairs of setting dies lie substantially in an imaginary plane passing through said spaced parallel rotation axes of the die holder means.

11. Apparatus according to claim 10 for setting fasteners when the blank is folded to a T-shape; wherein said plurality of rotary die holder means includes a first rotary die holder arranged for rotation about a first one of said parallel axes, and second and third rotary die holders mounted for rotation about the other one of said spaced parallel axes, the second and third rotary die holders being spaced apart in the axial direction by a distance sufficient to permit the leg of the T-shaped blank to pass therebetween during operation.

12. Apparatus according to claim 10 wherein the first rotary die holder carries said first set of said eyelet setting dies and said tang setting dies in circumferentially spaced relationship, with each of the dies of the first set being radially movable relative to said first axis of rotation, and means biasing each of the dies in the first set away from said first axis of rotation.

13. Apparatus according to claim 11 wherein said first set of said dies are disposed in pairs about the circumference of the first die holder, each pair comprising an eyelet setting die and a tang setting die, and the second rotary die holder carrying a set of said tang setting dies each arranged to come into said opposing relationship with a respective one of the tang setting dies of the first set, and the third rotary die holder carrying a set of said eyelet setting dies each arranged to come into said opposing relation with a respective one of the eyelet setting dies of the first set.

14. Apparatus according to claim 13 wherein the means for feeding the tangs and eyelets includes means for supplying individual tangs to respective tang setting dies of said first set prior to entry of such tang setting dies into said first nip, and magnetic means associated with the tang setting dies of the first set for retaining the individual tangs on the respective tang setting dies until the tangs have been set into said one of the arms of the blank.

15. Apparatus according to claim 13 wherein the means for supplying individual tangs comprises means for feeding a strip of interconnected tangs in step by step fashion toward a peripheral portion of said first rotary die holder means in timed relation to the rotation of the latter, and means for successively separating individual leading tangs from said strip and applying same to the respective tang setting dies for retention thereon by said magnetic means.

16. Apparatus according to claim 14 wherein the means for feeding tangs and eyelets includes chute means for delivering eyelets to a pick up station adjacent said second nip, means for temporarily holding successive leading ones of said eyelets at the pick-up station, means for moving successive dies of said first set radially outwardly relative to the rotation axis of the first die holder in such a way that each successive eyelet setting die comes into engagement with a respective one of said eyelets at the pick-up point, and means for supporting and guiding each said eyelet as it is carried into the second nip by the eyelet setting die associated therewith.

17. Apparatus according to claim 16 wherein each said eyelet setting die of the first set has a spring loaded plunger therein which enters into the eyelet at the pick-up station whereby to assist in positively moving each eyelet into the second nip.

18. Apparatus according to claim 16 or 17 wherein the means for supporting and guiding each eyelet is shaped such that the eyelet is forced radially inwardly relative to the first rotation axis thus causing the dies of the first set to be moved radially inwardly against the force of biasing means associated therewith as they approach the nip, the dies of the first set then moving radially outwardly as said momentary setting force is applied thereto by said cam means.

* * * * *